US010002616B2

(12) United States Patent
Miyasaka et al.

(10) Patent No.: US 10,002,616 B2
(45) **Date of Patent: *Jun. 19, 2018**

(54) AUDIO DECODING DEVICE

(71) Applicant: SOCIONEXT INC., Kanagawa (JP)

(72) Inventors: Shuji Miyasaka, Osaka (JP); Kazutaka Abe, Osaka (JP); Zong Xian Liu, Singapore (SG); Yong Hwee Sim, Singapore (SG); Anh Tuan Tran, Singapore (SG)

(73) Assignee: SOCIONEXT INC., Kanagawa (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/694,672

(22) Filed: Sep. 1, 2017

(65) Prior Publication Data

US 2017/0365262 A1 Dec. 21, 2017

Related U.S. Application Data

(63) Continuation of application No. 15/097,117, filed on Apr. 12, 2016, now Pat. No. 9,779,740, which is a (Continued)

(30) Foreign Application Priority Data

Oct. 17, 2013 (JP) ..... 2013-216821

(51) Int. Cl.
*H04R 5/00* (2006.01)
*G10L 19/008* (2013.01)

(Continued)

(52) U.S. Cl.
CPC ..... *G10L 19/008* (2013.01); *H04S 5/005* (2013.01); *G10L 19/002* (2013.01); *H04S 3/008* (2013.01);

(Continued)

(58) Field of Classification Search
CPC ..... G10L 19/008; G10L 19/002; H04S 3/008; H04S 5/005; H04S 2400/11; H04S 2400/15

(Continued)

(56) References Cited

U.S. PATENT DOCUMENTS

2004/0111171 A1 6/2004 Jang et al.
2009/0210238 A1 8/2009 Kim et al.

(Continued)

FOREIGN PATENT DOCUMENTS

EP 2 690 621 A1 1/2014
JP 2010-506231 A 2/2010

(Continued)

OTHER PUBLICATIONS

Information Technology—MPEG Audio Technologies; Part 1: MPEG Surround, Final Draft of International Standard for the International Organization for Standardization (ISO) and International Electrotechnical Commission (IEC), Reference No. ISO/IEC FDIS 23003-1: 2006(E). 290 pages.

(Continued)

*Primary Examiner* — Paul S Kim
(74) *Attorney, Agent, or Firm* — McDermott Will & Emery LLP

(57) ABSTRACT

An input signal includes a channel-based audio signal and an object-based audio signal, and an audio encoding device includes an audio scene analysis unit configured to determine an audio scene from the input signal and detect audio scene information; a channel-based encoder that encodes the channel-based audio signal output from the audio scene analysis unit; an object-based encoder that encodes the object-based audio signal output from the audio scene analysis unit; and an audio scene encoding unit configured to encode the audio scene information.

1 Claim, 16 Drawing Sheets

Related U.S. Application Data continuation of application No. PCT/JP2014/004247, filed on Aug. 20, 2014.

(51) Int. Cl.
*H04S 5/00* (2006.01)
*G10L 19/002* (2013.01)
*H04S 3/00* (2006.01)

(52) U.S. Cl.
CPC ..... *H04S 2400/11* (2013.01); *H04S 2400/15* (2013.01)

(58) Field of Classification Search
USPC ..... 381/22, 23
See application file for complete search history.

(56) References Cited

U.S. PATENT DOCUMENTS

| | | | |
|---|---|---|---|
| 2009/0326958 | A1 | 12/2009 | Kim et al. |
| 2010/0076772 | A1 | 3/2010 | Kim et al. |
| 2010/0284549 | A1 | 11/2010 | Oh et al. |
| 2010/0284551 | A1 | 11/2010 | Oh et al. |
| 2010/0296656 | A1 | 11/2010 | Oh et al. |
| 2010/0316230 | A1 | 12/2010 | Oh et al. |
| 2011/0051940 | A1 | 3/2011 | Ishikawa et al. |
| 2011/0200197 | A1 | 8/2011 | Kim et al. |
| 2011/0202356 | A1 | 8/2011 | Kim et al. |
| 2011/0202357 | A1 | 8/2011 | Kim et al. |
| 2012/0163608 | A1 | 6/2012 | Kishi et al. |
| 2012/0230497 | A1 | 9/2012 | Dressler et al. |
| 2012/0314875 | A1 | 12/2012 | Lee et al. |
| 2013/0202129 | A1 | 8/2013 | Kraemer et al. |
| 2014/0161261 | A1 | 6/2014 | Oh et al. |
| 2014/0297294 | A1 | 10/2014 | Kim et al. |
| 2014/0358567 | A1* | 12/2014 | Koppens ..... G10L 19/008 704/500 |

FOREIGN PATENT DOCUMENTS

| | | | |
|---|---|---|---|
| JP | 2011-509591 | A | 3/2011 |
| WO | 2008/100098 | A1 | 8/2008 |
| WO | 2009/084919 | A1 | 7/2009 |
| WO | 2010/109918 | A1 | 9/2010 |
| WO | 2012/125855 | A1 | 9/2012 |
| WO | 2013/006338 | A2 | 1/2013 |
| WO | 2013/108200 | A1 | 7/2013 |

OTHER PUBLICATIONS

Engdegard, J. et al. "Spatial Audio Object Coding (SAOC)—The Upcoming MPEG Standard on Parametric Object Based Audio Coding," Audio Engineering Society Convention Paper, 124th Convention, Amsterdam, The Netherlands, May 17-20, 2008.

International Search Report issued in corresponding International Patent Application No. PCT/JP2014/004247, dated Nov. 11, 2014; with English translation.

Written Opinion of the International Searching Authority, issued in corresponding International Patent Application No. PCT/JP2014/004247, dated Nov. 11, 2014; with English translation.

European Search Report issued in Application No. 14853892.9 dated Feb. 1, 2017.

Extended European Search Report issued in corresponding European Patent Application No. 14853892.9, dated Mar. 22, 2017.

Notice of Allowance issued in U.S. Appl. No. 15/097,117, dated Jun. 6, 2017.

* cited by examiner

AUDIO DECODING DEVICE

CROSS REFERENCE TO RELATED APPLICATIONS

This is a Continuation Application of U.S. patent application Ser. No. 15/097,117, filed on Apr. 12, 2016, now U.S. Pat No. 9,779,740, which is a Continuation Application of PCT International Application No. PCT/JP2014/004247 filed on Aug. 20, 2014, designating the United States of America, which is based on and claims priority of Japanese Patent Application No. 2013-216821 filed on Oct. 17, 2013. The entire disclosures of the above-identified applications, including the specifications, drawings and claims are incorporated herein by reference in their entirety.

FIELD

The present disclosure relates to an audio encoding device that compression-encodes signals, and an audio decoding device that decodes encoded signals.

BACKGROUND

In recent years, object-based audio systems capable of handling background sound have been proposed (see e.g., NPL 1). This technique proposes that background sound is input as a multi-channel background object (MBO) in the form of multi-channel signals, and the input signals are compressed into one channel signal or two channel signals by an MPS encoder (MPEG Surround encoder) and handled as a single object (see e.g., NPL 2).

CITATION LIST

Non Patent Literature

[NPL 1] Jonas Engdegard, Barbara Resch, Cornelia Falch, Oliver Hellmuth, Johannes Hilpert, Andreas Hoelzer, Leonid Terentiev, Jeroen Breebaart, Jeroen Koppens, Erik Schuijers and Werner Oomen, "Spatial Audio Object Coding (SAOC) The Upcoming MPEG Standard on Parametric Object Based Audio Coding." in AES 124th Convention, Amsterdam, 2008, May 17-20.

[NPL 2] ISO/IEC 23003-1

SUMMARY

Technical Problem

However, in the case of the configuration as described above, background sound is compressed into one channel or two channels, and thus cannot be completely restored to the original background sound at the decoding side, resulting in the problem of audio quality degradation. Moreover, the decoding process of the background sound requires an enormous amount of computation.

The present disclosure has been made in view of the above-described problems, and it is an object of the disclosure to provide an audio encoding device and an audio decoding device that achieve high audio quality and require less amount of computation during decoding.

Solution to Problem

In order to solve the above-described problems, an audio encoding device according to an aspect of the present disclosure is an audio encoding device that encodes an input signal, the input signal including a channel-based audio signal and an object-based audio signal, the audio encoding device including: an audio scene analysis unit configured to determine an audio scene from the input signal and detect audio scene information; a channel-based encoder that encodes the channel-based audio signal output from the audio scene analysis unit; an object-based encoder that encodes the object-based audio signal output from the audio scene analysis unit; and an audio scene encoding unit configured to encode the audio scene information.

An audio decoding device according to an aspect of the present disclosure is an audio decoding device that decodes an encoded signal resulting from encoding an input signal, the input signal including a channel-based audio signal and an object-based audio signal, the encoded signal containing a channel-based encoded signal resulting from encoding the channel-based audio signal, an object-based encoded signal resulting from encoding the object-based audio signal, and an audio scene encoded signal resulting from encoding audio scene information extracted from the input signal, the audio decoding device including: a demultiplexing unit configured to demultiplex the encoded signal into the channel-based encoded signal, the object-based encoded signal, and the audio scene encoded signal; an audio scene decoding unit configured to extract, from the encoded signal, an encoded signal of the audio scene information, and decode the encoded signal of the audio scene information; a channel-based decoder that decodes the channel-based audio signal; an object-based decoder that decodes the object-based audio signal by using the audio scene information decoded by the audio scene decoding unit; and an audio scene synthesis unit configured to combine an output signal of the channel-based decoder and an output signal of the object-based decoder based on speaker arrangement information provided separately from the audio scene information, and reproduce a combined audio scene synthesis signal.

Advantageous Effects

According to the present disclosure, it is possible to provide an audio encoding device and an audio decoding device that achieve high audio quality and require less amount of computation during decoding.

BRIEF DESCRIPTION OF DRAWINGS

These and other objects, advantages and features of the invention will become apparent from the following description thereof taken in conjunction with the accompanying drawings that illustrate a specific embodiment of the present invention.

DESCRIPTION OF EMBODIMENTS (Underlying Knowledge Forming Basis of the Present Disclosure)

Before describing embodiments of the present disclosure, the underlying knowledge forming the basis of the present disclosure will be described.

There is known a sound field reproduction technique for encoding and decoding background sound by using a channel-based audio system and an object-based audio system.

Figure 15:
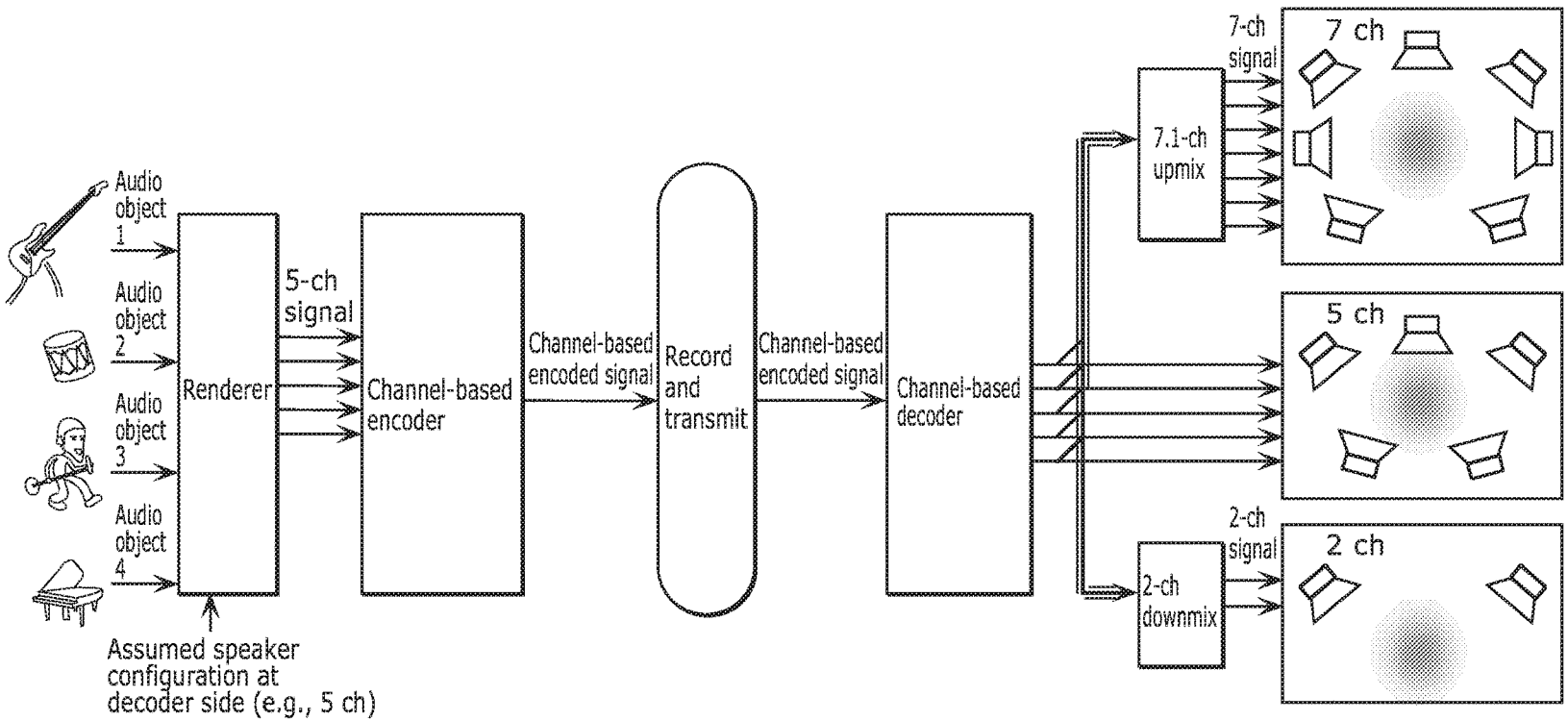
FIG. 15 is a diagram showing a configuration of a channel-based audio system according to the conventional art.

A configuration of a channel-based audio system is shown in FIG. 15.

In the channel-based audio system, a group of picked-up sound sources (guitar, piano, vocal etc.) are rendered in advance according to the reproduction speaker arrangement assumed by the system. Rendering is to assign a signal of each sound source to each speaker such that the sound source forms a sound image at the intended position. For example, when the speaker arrangement assumed by the system is a 5-channel speaker arrangement, a group of picked-up sound sources are assigned to the channels such that the sound sources are reproduced at appropriate sound image positions by 5-channel speakers. The thus generated signals of the channels are encoded, recorded, and transmitted.

At the decoder side, the decoded signals are directly assigned to the speakers if the speaker configuration (the number of channels) is the configuration assumed by the system. If not, the decoded signals are upmixed (converted to a number of channels greater than the number of channels of the decoded signals) or downmixed (converted to a number of channels less than the number of channels of the decoded signals), according to the speaker configuration.

That is, as shown in FIG. 15, the channel-based audio system assigns picked-up sound sources to 5-channel signals by a renderer, encodes the signals by a channel-based encoder, and records and transmits the encoded signal. Thereafter, the encoded signal is decoded by a channel-based decoder, and the decoded 5-channel sound field and an additional sound field that is downmixed 2-channels or upmixed to 7.1-channels are reproduced by the speakers.

An advantage of the system is that an optimum sound field can be reproduced without imposing a load on the decoding side if the speaker configuration at the decoding side is the configuration assumed by the system. Furthermore, for example, a signal such as an acoustic signal with background sound or reverberation can be appropriately represented by appropriately adding the signal to the channel signals.

A disadvantage of this system is that the process must be carried out with a computational load of upmixing or downmixing, and yet still cannot reproduce an optimum sound field if the speaker configuration at the decoding side is not the configuration assumed by the system.

Figure 16:
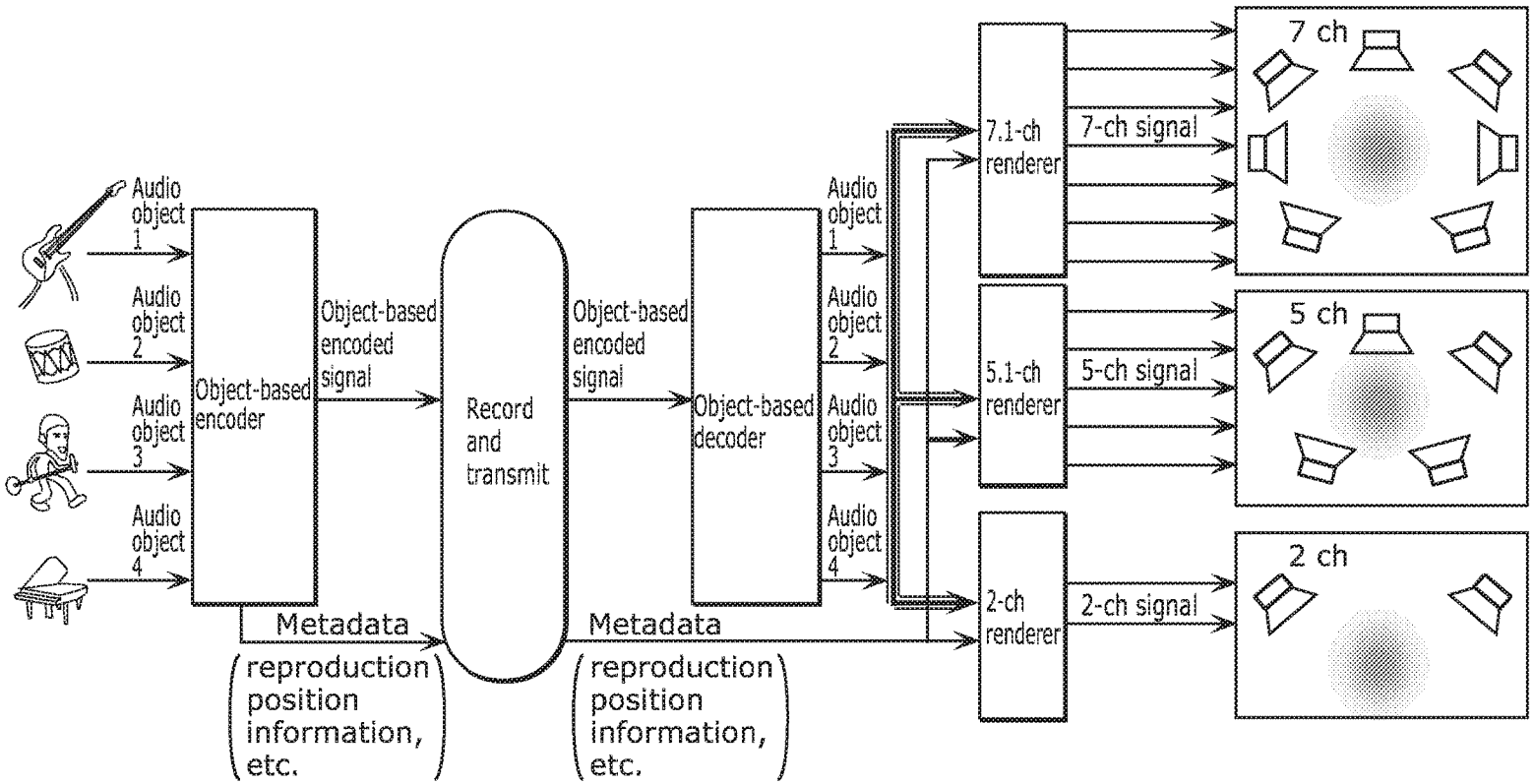
FIG. 16 is a diagram showing a configuration of an object-based audio system according to the conventional art.

A configuration of an object-based audio system is shown in FIG. 16.

In the object-based audio system, a group of picked-up sound sources (guitar, piano, vocal, etc.) are directly encoded as audio objects, and the audio objects are recorded and transmitted. At this time, reproduction position information of the sound sources is also recorded and transmitted. At the decoder side, the audio objects are rendered according to the position information of the sound sources and the speaker arrangement.

For example, when the speaker arrangement of the decoding side is a 5-channel speaker arrangement, the audio objects are assigned to channels such that the audio objects are reproduced by 5-channel speakers at positions corresponding to the respective reproduction position information.

That is, as shown in FIG. 16, the object-based audio system encodes a group of picked-up sound sources by an object-based encoder, and records and transmits the encoded signal. Thereafter, the encoded signal is decoded by an object-based decoder, and the sound field is reproduced by the speakers of the channels via a 2-channel, 5.1-channel, or 7.1-channel renderer.

An advantage of this system is that an optimum sound field can be reproduced according to the speaker arrangement at the reproduction side.

A disadvantage of this system is that a computational load is imposed on the decoder side, and a signal such as an acoustic signal with background sound or reverberation cannot be appropriately represented as an audio object.

In this respect, object-based audio systems capable of handling background sound have been proposed in recent years. This technique proposes that background sound is input as a multi-channel background object (MBO) in the form of multi-channel signals, and the input signals are compressed into one channel signal or two channel signals by an MPS encoder (MPEG Surround encoder) and handled as a single object. The configuration is described in FIG. 5: Architecture of the SAOC system handling the MBO of NPL 1.

However, the configuration of the above-described object-based audio system has the problem that background sound is compressed into one channel or two channels and thus cannot be completely restored to the original background sound at the decoding side. There is also a problem that such a process requires an enormous amount of computation.

Furthermore, for the conventional object-based audio systems, the guideline for bit allocation to audio objects during compression-encoding of the object-based audio signal has not been established.

In view of the above-described conventional problems, an audio encoding device and an audio decoding device described below have been achieved that receive a channel-based audio signal and an object-based audio signal as inputs, achieve high audio quality, and yet require less amount of computation during decoding.

That is, in order to solve the above-described problems, an audio encoding device is an audio encoding device that encodes an input signal, the input signal including a channel-based audio signal and an object-based audio signal, the audio encoding device including: an audio scene analysis unit configured to determine an audio scene from the input signal and detect audio scene information; a channel-based encoder that encodes the channel-based audio signal output from the audio scene analysis unit; an object-based encoder that encodes the object-based audio signal output from the audio scene analysis unit; and an audio scene encoding unit configured to encode the audio scene information.

With this configuration, it is possible to encode the channel-based audio signal and the object-based audio signal while allowing these signals to appropriately coexist.

The audio scene analysis unit is further configured to separate the input signal into the channel-based audio signal and the object-based audio signal, and output the channel-based audio signal and the object-based audio signal.

With this configuration, it is possible to appropriately convert the channel-based audio signal to the object-based audio signal or vice versa.

The audio scene analysis unit is configured to extract perceptual importance information of at least the object-based audio signal, and determine a number of encoding bits allocated to each of the channel-based audio signal and the object-based audio signal according to the extracted perceptual importance information, the channel-based encoder encodes the channel-based audio signal according to the number of encoding bits, and the object-based encoder encodes the object-based audio signal according to the number of encoding bits.

With this configuration, it is possible to allocate appropriate encoding bits to the channel-based audio signal and the object-based audio signal The audio scene analysis unit is configured to detect at least one of: a number of audio objects contained in the object-based audio signal included in the input signal; a volume of sound of each of the audio objects; a transition of the volume of sound of each of the audio objects; a position of each of the audio objects; a trajectory of the position of each of the audio objects; a frequency characteristic of each of the audio objects; a masking characteristic of each of the audio objects; and a relationship between each of the audio objects and a video signal, and determine the number of encoding bits allocated to each of the channel-based audio signal and the object-based audio signal according to the detected result.

With this configuration, it is possible to accurately calculate the perceptual importance of the object-based audio signal.

The audio scene analysis unit is configured to detect at least one of: a volume of sound of each of a plurality of audio objects contained in the object-based audio signal of the input signal; a transition of the volume of sound of each of the plurality of audio objects; a position of each of the plurality of audio objects; a trajectory of the position of each of the audio objects; a frequency characteristic of each of the audio objects; a masking characteristic of each of the audio objects; and a relationship between each of the audio object and a video signal, and determine the number of encoding bits allocated to each of the audio objects according to the detected result.

With this configuration, it is possible to accurately calculate the perceptual importance of a plurality of object-based audio signals.

An encoding result of perceptual importance information of the object-based audio signal is stored in a bit stream as a pair with an encoding result of the object-based audio signal, and the encoding result of the perceptual importance information is placed before the encoding result of the object-based audio signal.

With this configuration, the object-based audio signal and the perceptual importance information thereof can be easily known at the decoder side.

For each of the audio objects, an encoding result of perceptual importance information of the audio object is stored in a bit stream as a pair with an encoding result of the audio object, and an encoding result of the perceptual importance information is placed before the encoding result of the audio object.

With this configuration, individual audio objects and the perceptual importance information thereof can be easily known at the decoder side.

In order to solve the above-described problems, there is provided an audio decoding device that decodes an encoded signal resulting from encoding an input signal, the input signal including a channel-based audio signal and an object-based audio signal, the encoded signal containing a channel-based encoded signal resulting from encoding the channel-based audio signal, an object-based encoded signal resulting from encoding the object-based audio signal as audio objects, and an audio scene encoded signal resulting from encoding audio scene information extracted from the input signal, the audio decoding device including: a demultiplexing unit configured to demultiplex the encoded signal into the channel-based encoded signal, the object-based encoded signal, and the audio scene encoded signal; an audio scene decoding unit configured to extract, from the encoded signal, an encoded signal of the audio scene information, and decode the encoded signal of the audio scene information; a channel-based decoder that decodes the channel-based audio signal; an object-based decoder that decodes the object-based audio signal by using the audio scene information decoded by the audio scene decoding unit; and an audio scene synthesis unit configured to combine an output signal of the channel-based decoder and an output signal of the object-based decoder based on speaker arrangement information provided separately from the audio scene information, and reproduce a combined audio scene synthesis signal.

With this configuration, it is possible to perform reproduction that appropriately reflects the audio scene.

The audio scene information is encoding bit number information of the audio objects, and the audio decoding device determines, based on information that is provided separately, an audio object that is not to be reproduced from among the audio objects, and skip the audio object that is not to be reproduced, based on a number of encoding bits of the audio object.

With this configuration, it is possible to appropriately skip an audio object according to the status during reproduction.

The audio scene information is perceptual importance information of the audio objects, and indicates that the audio decoding device may discard an audio object included in the audio objects that has a low perceptual importance when a computational resource necessary for decoding is insufficient.

With this configuration, it is possible to achieve reproduction even with a processor having a small computing capacity, while maintaining the audio quality as much as possible.

The audio scene information is audio object position information, and the audio decoding device determines a head related transfer function (HRTF) used for performing downmixing for speakers, from the audio object position information, reproduction-side speaker arrangement information that is provided separately, and listener position information that is provided separately or pre-supposed.

With this configuration, it is possible to achieve reproduction with a heightened perception of reality according to the position information of the listener.

The following describes embodiments according to an aspect of the audio encoding device and the audio decoding device described above. Note that each of the embodiments described below merely shows a specific example. The numerical values, shapes, materials, components, arrangements and connections of components, and so forth shown in the following embodiments are mere examples, and are not intended to limit the scope of the disclosure. The present disclosure is defined by the appended claims. Accordingly, of the components in the following embodiments, components not recited in any of the independent claims are not essential for achieving the object of the present disclosure, but are described as preferable configurations.

[Embodiment 1]

Hereinafter, an audio encoding device according to Embodiment 1 will be described with reference to the drawings.

Figure 1:
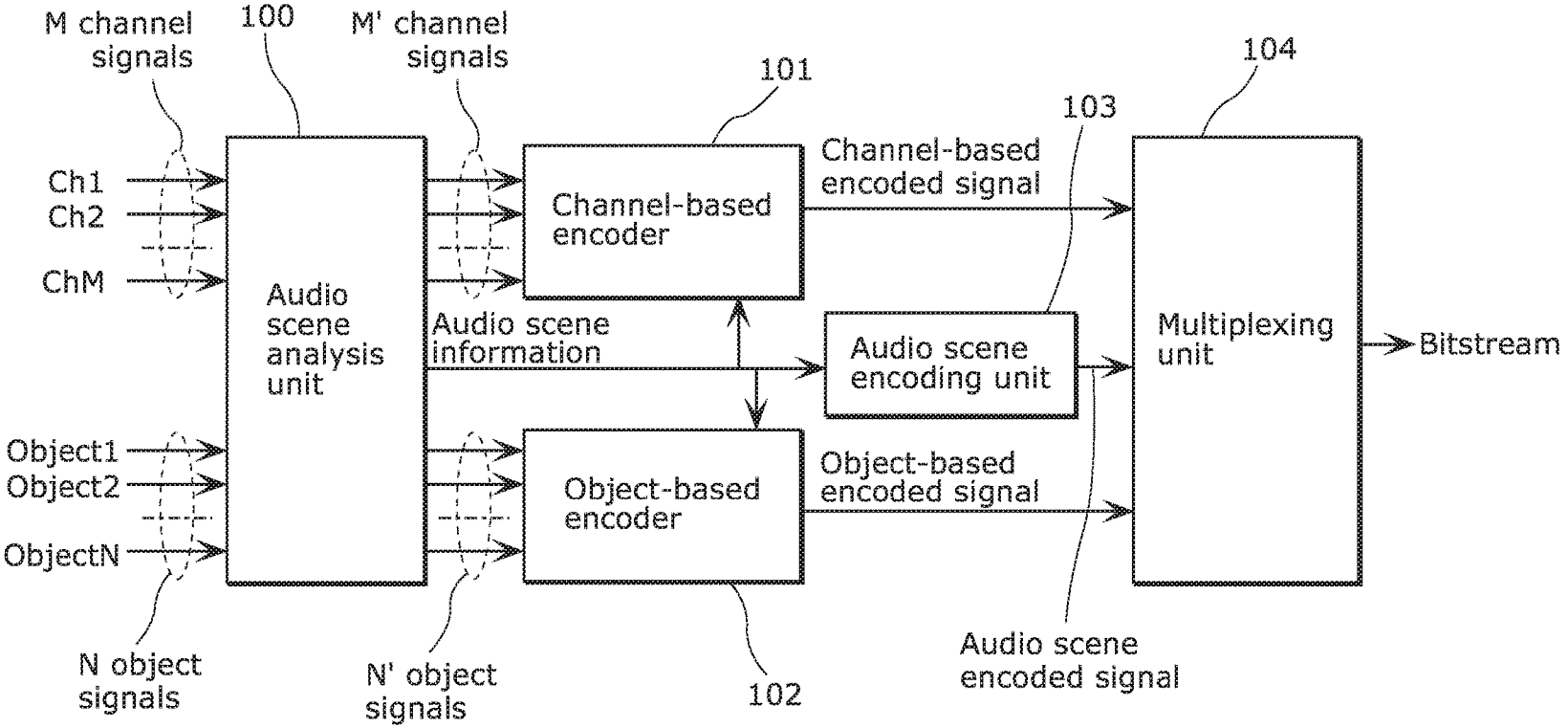
FIG. 1 is a diagram showing a configuration of an audio encoding device according to Embodiment 1.

FIG. 1 is a diagram showing a configuration of an audio encoding device according to the present embodiment.

As shown in FIG. 1, the audio encoding device includes an audio scene analysis unit 100, a channel-based encoder 101, an object-based encoder 102, and an audio scene encoding unit 103, and a multiplexing unit 104.

The audio scene analysis unit 100 determines an audio scene from an input signal composed of a channel-based audio signal and an object-based audio signal, and detects audio scene information.

The channel-based encoder 101 encodes the channel-based audio signal that is an output signal of the audio scene analysis unit 100, based on the audio scene information that is an output signal of the audio scene analysis unit 100.

The object-based encoder 102 encodes the object-based audio signal that is an output signal of the audio scene analysis unit 100, based on the audio scene information that is an output signal of the audio scene analysis unit 100.

The audio scene encoding unit 103 encodes the audio scene information that is an output signal of the audio scene analysis unit 100.

The multiplexing unit 104 multiplexes the channel-based encoded signal that is an output signal of the channel-based encoder 101, the object-based encoded signal that is an output signal of the object-based encoder 102, and the audio scene encoded signal that is an output signal of the audio scene encoding unit 103 to generate a bit stream, and outputs the bit stream.

The operation of the audio encoding device configured as above will be described below.

First, in the audio scene analysis unit 100, an audio scene is determined from an input signal composed of a channel-based audio signal and an object-based audio signal, and audio scene information is detected.

The functions of the audio scene analysis unit 100 can be roughly classified into two types. One is to reconfigure the channel-based audio signal and the object-based audio signal, and the other is to determine the perceptual importance of audio objects, which are individual elements of the object-based audio signal.

The audio scene analysis unit 100 according to the present embodiment has the two functions at the same time. Note that the audio scene analysis unit 100 may have only one of the two functions.

First, the function of reconfiguring the channel-based audio signal and the object-based audio signal will be discussed.

The audio scene analysis unit 100 analyzes the input channel-based audio signal, and, if a specific channel signal is independent of the other channel signals, separates that channel signal from the input channel-based audio signal and incorporates the separated channel signal in the object-based audio signal. In that case, the reproduction position information of the audio signal represents the position at which the speaker of that channel is supposed to be placed.

For example, when sentences (lines) are recorded in the signal of the center channel, the signal of that channel may be handled as an object-based audio signal (audio object). In this case, the reproduction position of the audio object is the center. Doing so allows the audio object to be rendered at the center position by using another speaker at the reproduction side (decoder side) even if the speaker of the center channel cannot be placed at the center position due to physical constraints, for example.

On the other hand, an acoustic signal with background sound or reverberation is output as a channel-based audio signal. Doing so allows a reproduction process to be executed with high audio quality and less amount of computation at the decoder side.

Furthermore, the audio scene analysis unit 100 may analyze the input object-based audio signal, and, if a specific audio object is present at the position of a specific speaker, may mix that audio object with a channel signal output from the speaker.

For example, when an audio object representing the sound of a certain musical instrument is present at the position of the right speaker, the audio object may be mixed with a channel signal output from the right speaker. Doing so can reduce the number of audio objects by one, and thus contributes to a reduction in the bit rate during transmission and recording.

Next, of the functions of the audio scene analysis unit 100, the function of determining the perceptual importance of audio objects will be described.

Figure 2:
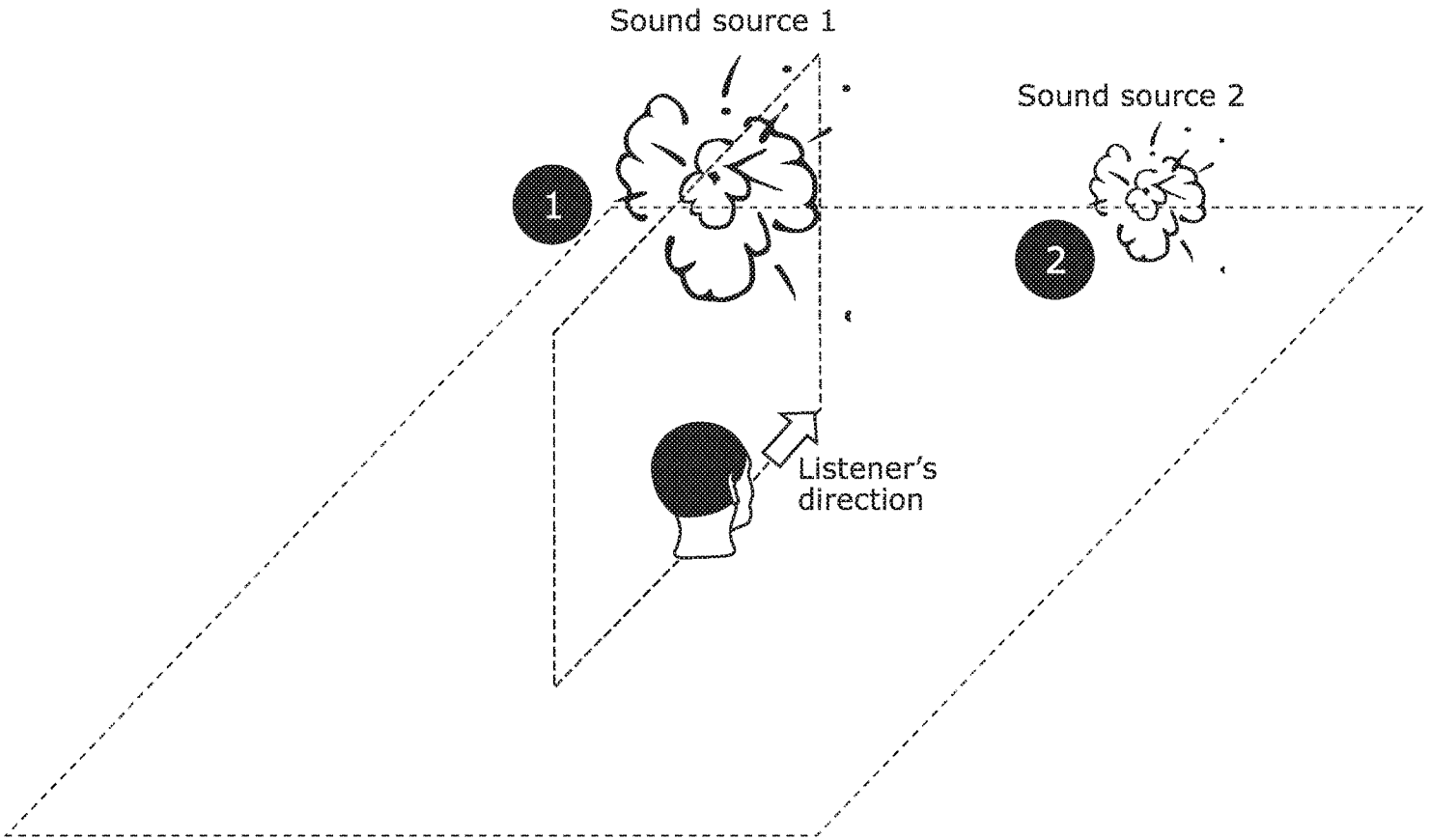
FIG. 2 is a diagram showing an exemplary method for determining the perceptual importance of audio objects.

As shown in FIG. 2, the audio scene analysis unit 100 determines that an audio object with a high sound pressure level has a higher perceptual importance than that of an audio object with a low sound pressure level. This is to reflect the listener's psychology that more attention is paid to a sound with a high sound pressure level.

For example, in FIG. 2, Sound source 1 indicated by Black circle 1 has a higher sound pressure level than that of Sound source 2 indicated by Black circle 2. In this case, it is determined that Sound source 1 has a higher perceptual importance than that of Sound source 2.

Figure 3:
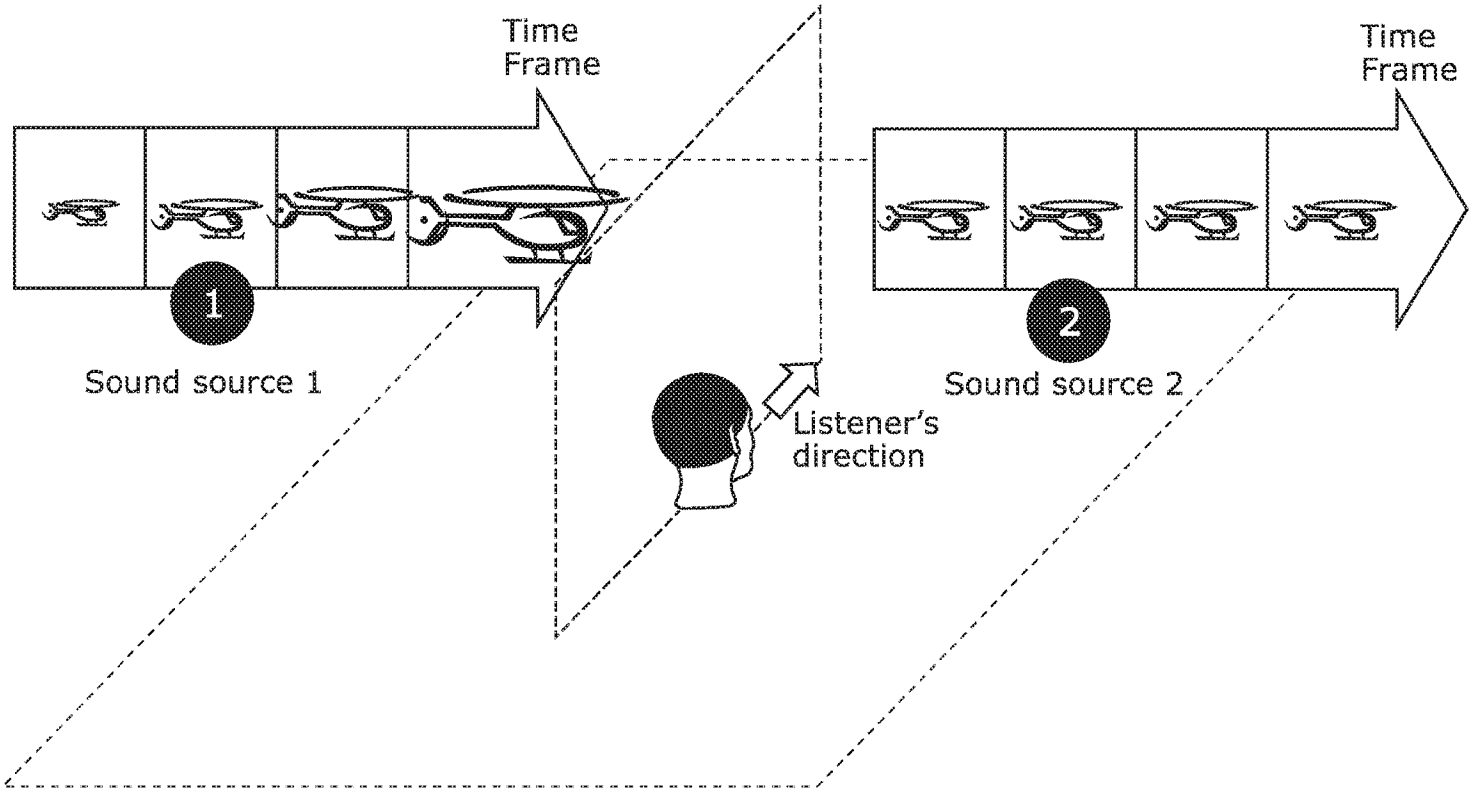
FIG. 3 is a diagram showing an exemplary method for determining the perceptual importance of audio objects.

As shown in FIG. 3, the audio scene analysis unit 100 determines that an audio object whose reproduction position moves closer to the listener has a higher perceptual importance than that of an audio object whose reproduction position moves away from the listener. This is to reflect the listener's psychology that more attention is paid to an approaching object.

For example, in FIG. 3, Sound source 1 indicated by Black circle 1 is a sound source that moves closer to the listener, and Sound source 2 indicated by Black circle 2 is a sound source that moves away from the listener. In this case, it is determined that Sound source 1 has a higher perceptual importance than that of Sound source 2.

Figure 4:
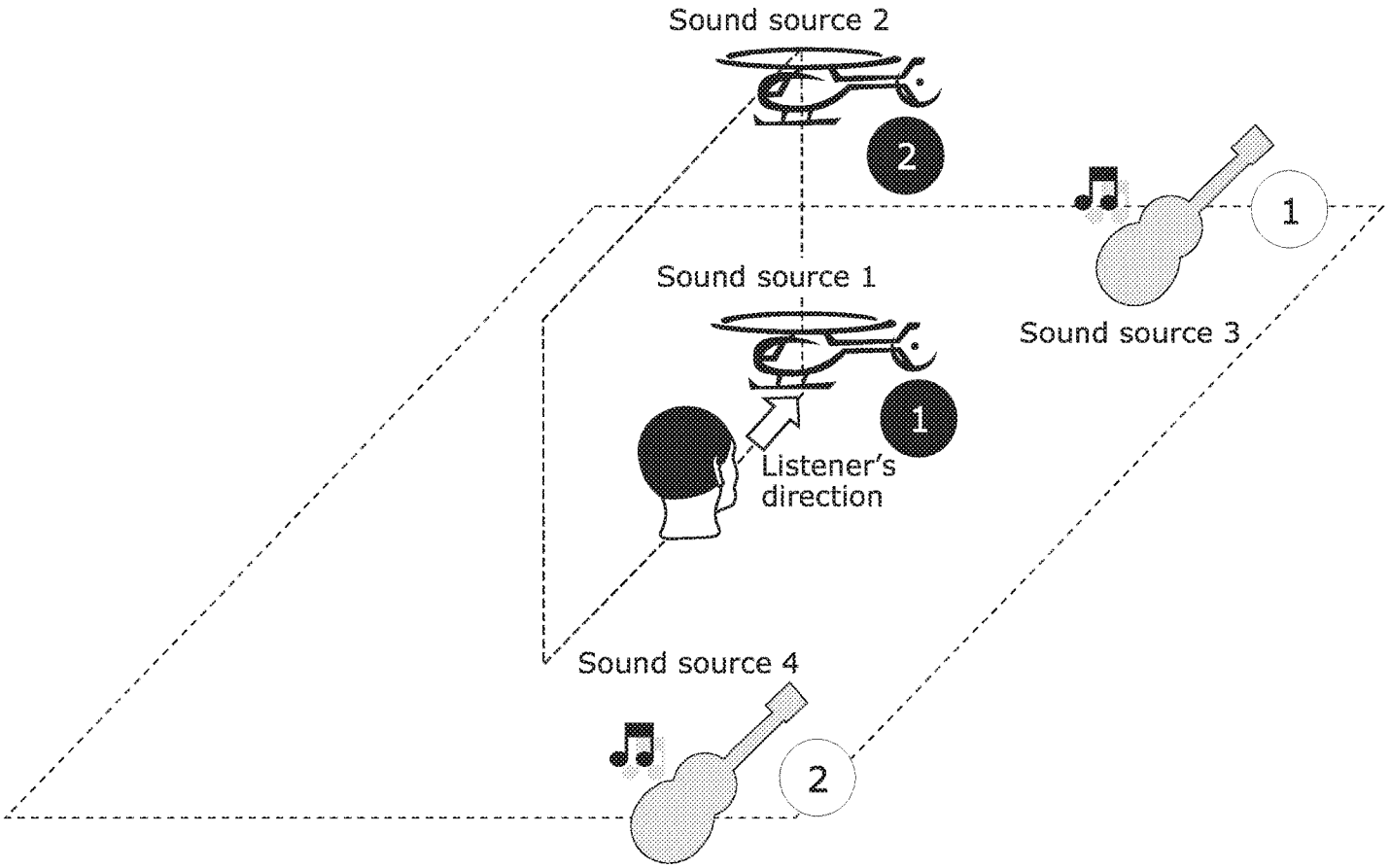
FIG. 4 is a diagram showing an exemplary method for determining the perceptual importance of audio objects.

As shown in FIG. 4, the audio scene analysis unit 100 determines that an audio object whose reproduction position is located forward of the listener has a higher perceptual importance than that of an audio object whose reproduction position is located rearward of the listener.

Further, the audio scene analysis unit 100 determines that an audio object whose reproduction position is located in front of the listener has a higher perceptual importance than that of an audio object whose reproduction position is located above the listener. The reason is that the listener's sensitivity to an object located forward of the listener is higher than the listener's sensitivity to an object located on the lateral side of the listener, and the listener's sensitivity to an object located to the lateral side of the listener has a higher perceptual importance than that of the listener's sensitivity to an object located above or below the listener.

For example, in FIG. 4, Sound source 3 indicated by White circle 1 is at a position forward of the listener, and Sound source 4 indicated by White circle 2 is at a position rearward of the listener. In this case, it is determined that Sound source 3 has a higher perceptual importance than that of Sound source 4. Further, in FIG. 4, Sound source 1 indicated by Black circle 1 is at a position in front of the listener, and Sound source 2 indicated by Black circle 2 is at a position above the listener. In this case, it is determined that Sound source 1 has a higher perceptual importance than that of Sound source 2.

Figure 5:
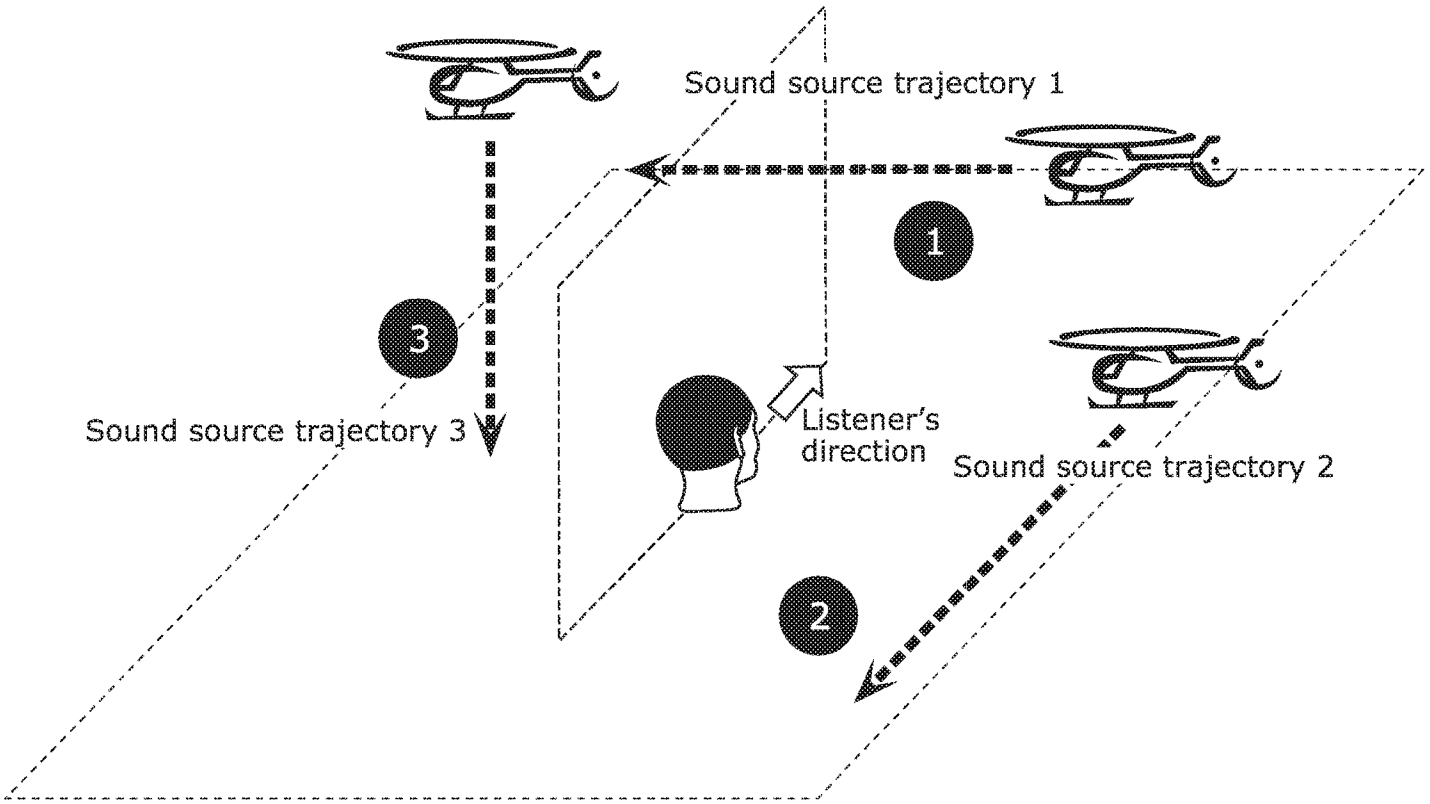
FIG. 5 is a diagram showing an exemplary method for determining the perceptual importance of audio objects.

As shown in FIG. 5, the audio scene analysis unit 100 determines that an audio object whose reproduction position moves left and right relative to the listener has a higher perceptual importance than that of an audio object whose reproduction position moves back and forth relative to the listener. Further, the audio scene analysis unit 100 determines that an audio object whose reproduction position moves back and forth relative to the listener has a higher perceptual importance than that of an audio object whose reproduction position moves up and down relative to the listener. The reason is that the listener's sensitivity to a right-and-left movement is higher than the listener's sensitivity to a back-and-forth movement, and the listener's sensitivity to a back-and-forth movement is higher than the listener's sensitivity to an up-and-down movement.

For example, in FIG. 5, Sound source trajectory 1 indicated by Black circle 1 moves left and right relative to the listener, Sound source trajectory 2 indicated by Black circle 2 moves back and forth relative to the listener, and Sound source trajectory 3 indicated by Black circle 3 moves up and down relative to the listener. In this case, it is determined that Sound source trajectory 1 has a higher perceptual importance than that of Sound source trajectory 2. Further, it is determined that Sound source trajectory 2 has a higher perceptual importance than that of Sound source trajectory 3.

Figure 6:
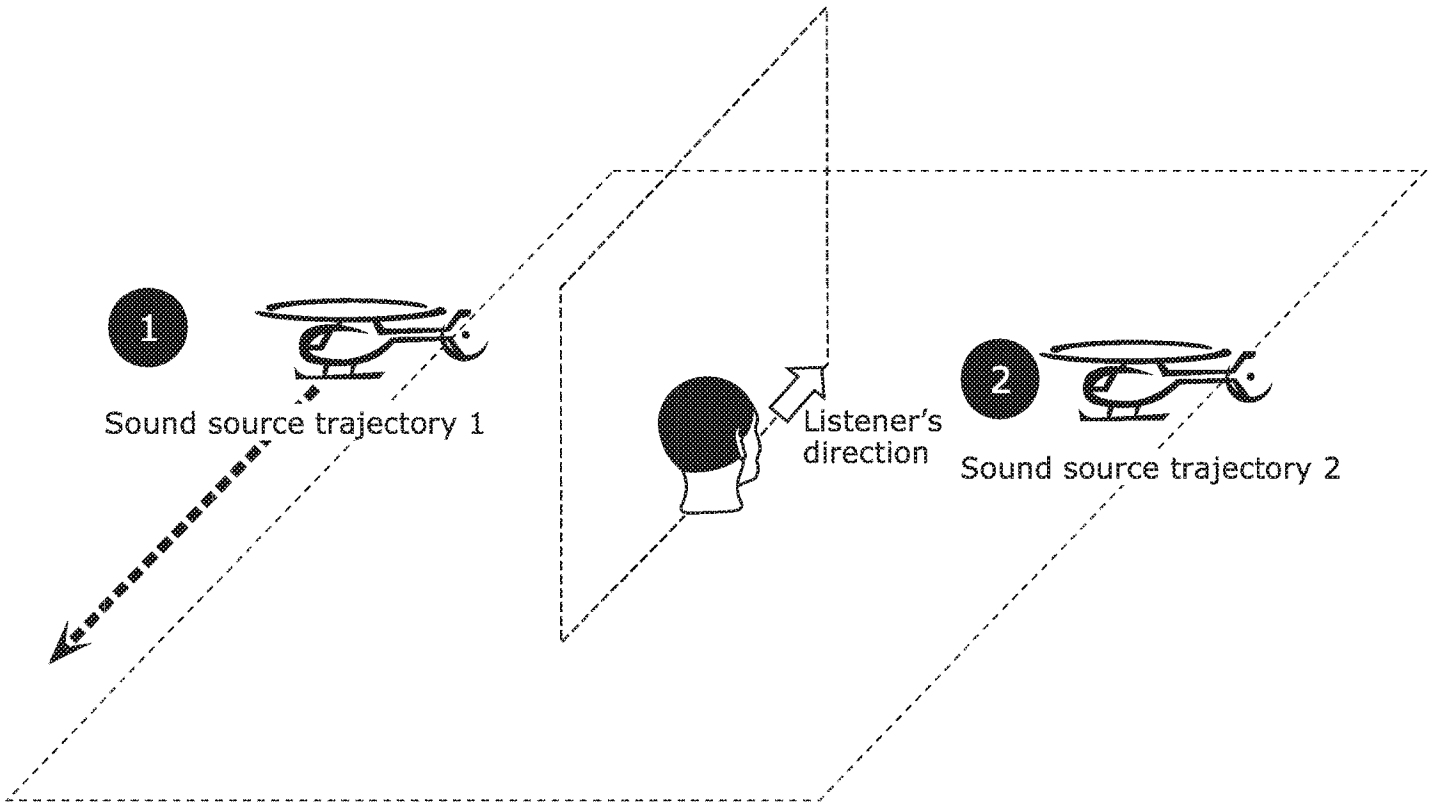
FIG. 6 is a diagram showing an exemplary method for determining the perceptual importance of audio objects.

As shown in FIG. 6, the audio scene analysis unit 100 determines that an audio object whose reproduction position is moving has a higher perceptual importance than that of an audio object whose reproduction position is stationary. Further, the audio scene analysis unit 100 determines that an audio object with a faster movement speed has a higher perceptual importance than that of an audio object with a slower movement speed. The reason is that the listener's auditory sensitivity to the movement of a sound source is high.

For example, in FIG. 6, Sound source trajectory 1 indicated by Black circle 1 is moving relative to the listener, and Sound source trajectory 2 indicated by Black circle 2 is stationary relative to the listener. In this case, it is determined that Sound source trajectory 1 has a higher perceptual importance than that of Sound source trajectory 2.

Figure 7:
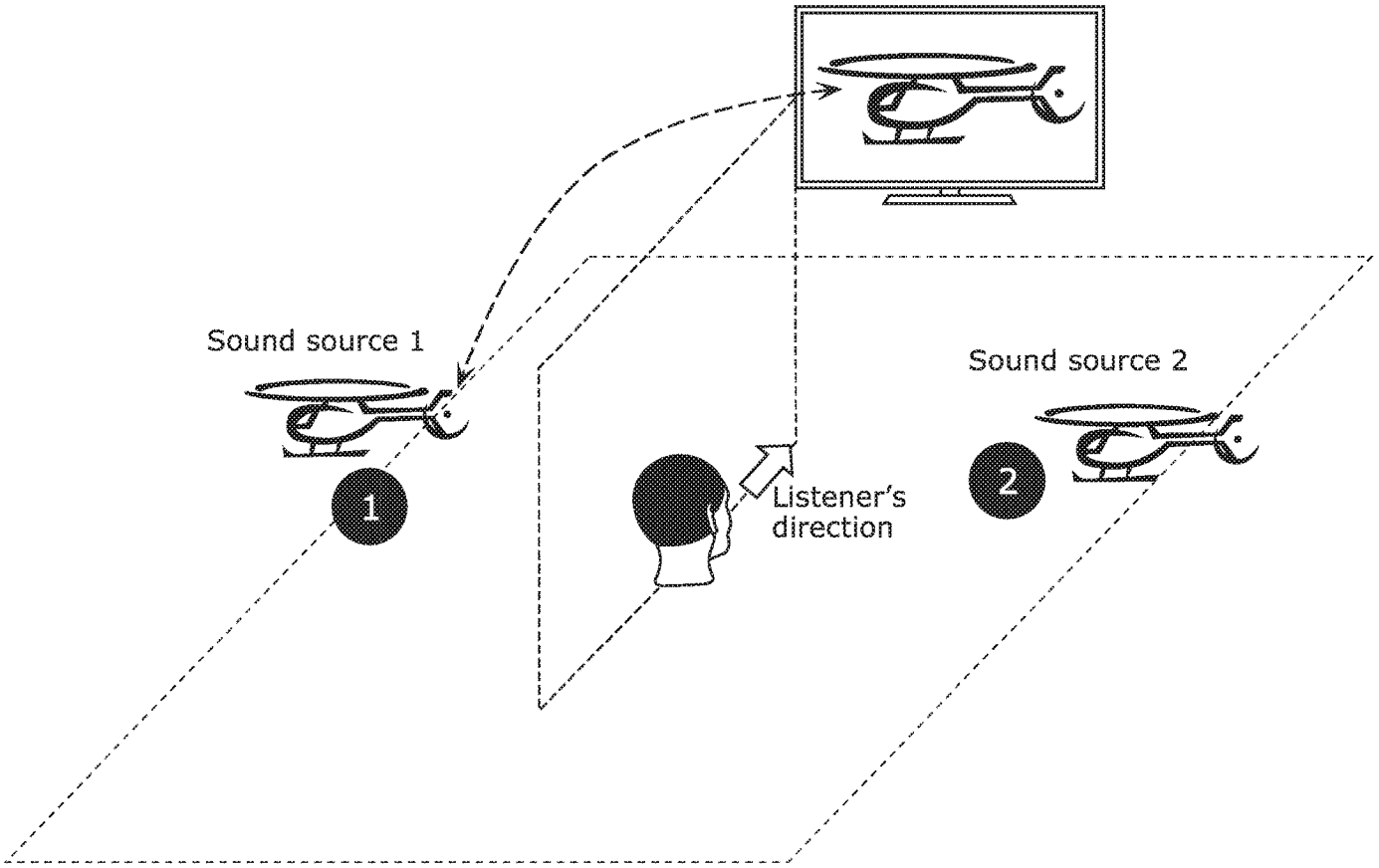
FIG. 7 is a diagram showing an exemplary method for determining the perceptual importance of audio objects.

As shown in FIG. 7, the audio scene analysis unit 100 determines that an audio object whose corresponding object is shown on a screen has a higher perceptual importance than that of an audio object whose corresponding object is not shown.

For example, in FIG. 7, Sound source 1 indicated by Black circle 1 is stationary or moving relative to the listener, and also shown on the screen. The position of Sound source 2 indicated by Black circle 2 is identical to that of Sound source 1. In this case, it is determined that Sound source 1 has a higher perceptual importance than that of Sound source 2.

Figure 8:
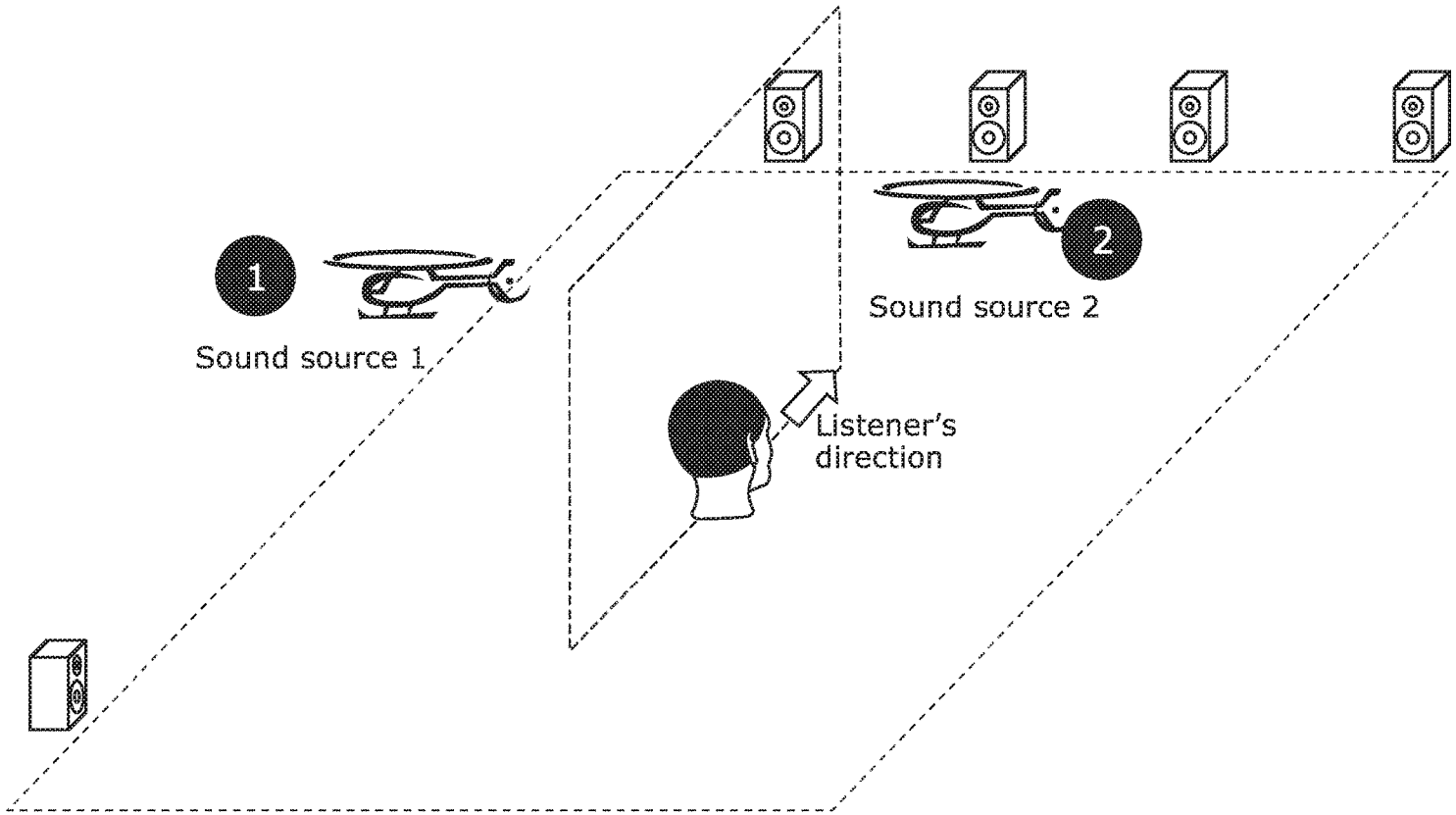
FIG. 8 is a diagram showing an exemplary method for determining the perceptual importance of audio objects.

As shown in FIG. 8, the audio scene analysis unit 100 determines that an audio object that is rendered by few speakers has a higher perceptual importance than that of an audio object that is rendered by many speakers. This is based on the idea that an audio object that is rendered by many speakers is assumed to be able to reproduce a sound image more accurately than an audio object that is rendered by few speakers, and therefore, the audio object that is rendered by fewer speakers should be encoded more accurately.

For example, in FIG. 8, Sound source 1 indicated by Black circle 1 is rendered by one speaker, and Sound source 2 indicated by Black circle 2 is rendered by a larger number of speakers, namely, four speakers, than Sound source 1. In this case, it is determined that Sound source 1 has a higher perceptual importance than that of Sound source 2.

Figure 9:
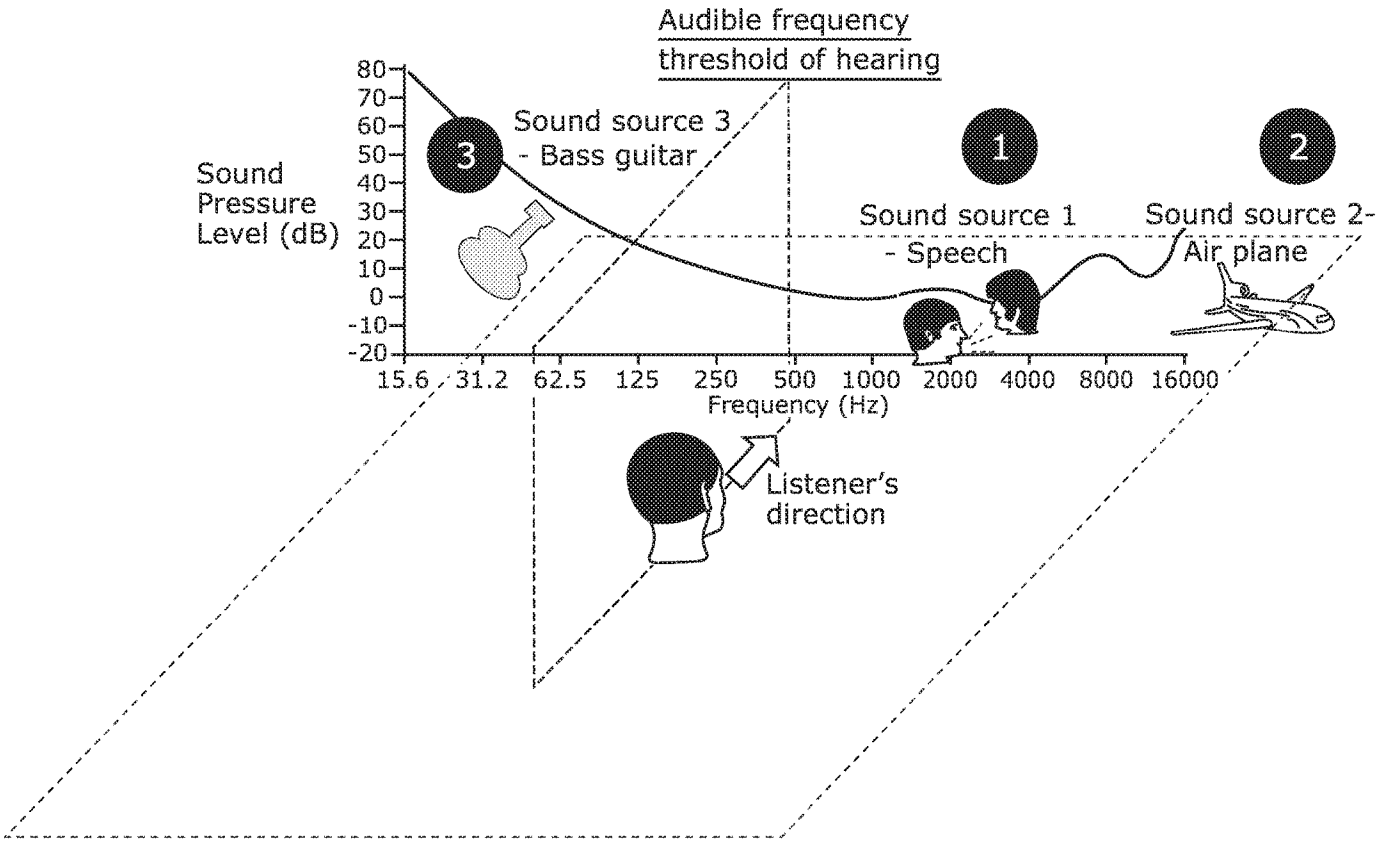
FIG. 9 is a diagram showing an exemplary method for determining the perceptual importance of audio objects.

As shown in FIG. 9, the audio scene analysis unit 100 determines that an audio object containing many frequency components that are highly auditory sensitive has a higher perceptual importance than that of an audio object containing many frequency components that are not highly auditory sensitive.

For example, in FIG. 9, Sound source 1 indicated by Black circle 1 is a sound of the frequency band of the human voice, Sound source 2 indicated by Black circle 2 is a sound of the frequency band of the flying sound of an aircraft and the like, and Sound source 3 indicated by Black circle 3 is a sound of the frequency band of a bass guitar. Here, human hearing has a high sensitivity to a sound (object) containing frequency components of the human voice, a moderate sensitivity to a sound containing frequency components higher than the human voice frequencies, such as the flying sound of an aircraft, and a low sensitivity to a sound containing frequency components lower than the human voice frequencies, such as the sound of a bass guitar. In this case, it is determined that Sound source 1 has a higher perceptual importance than that of Sound source 2. Further, it is determined that Sound source 2 has a higher perceptual importance than that of Sound source 3.

Figure 10:
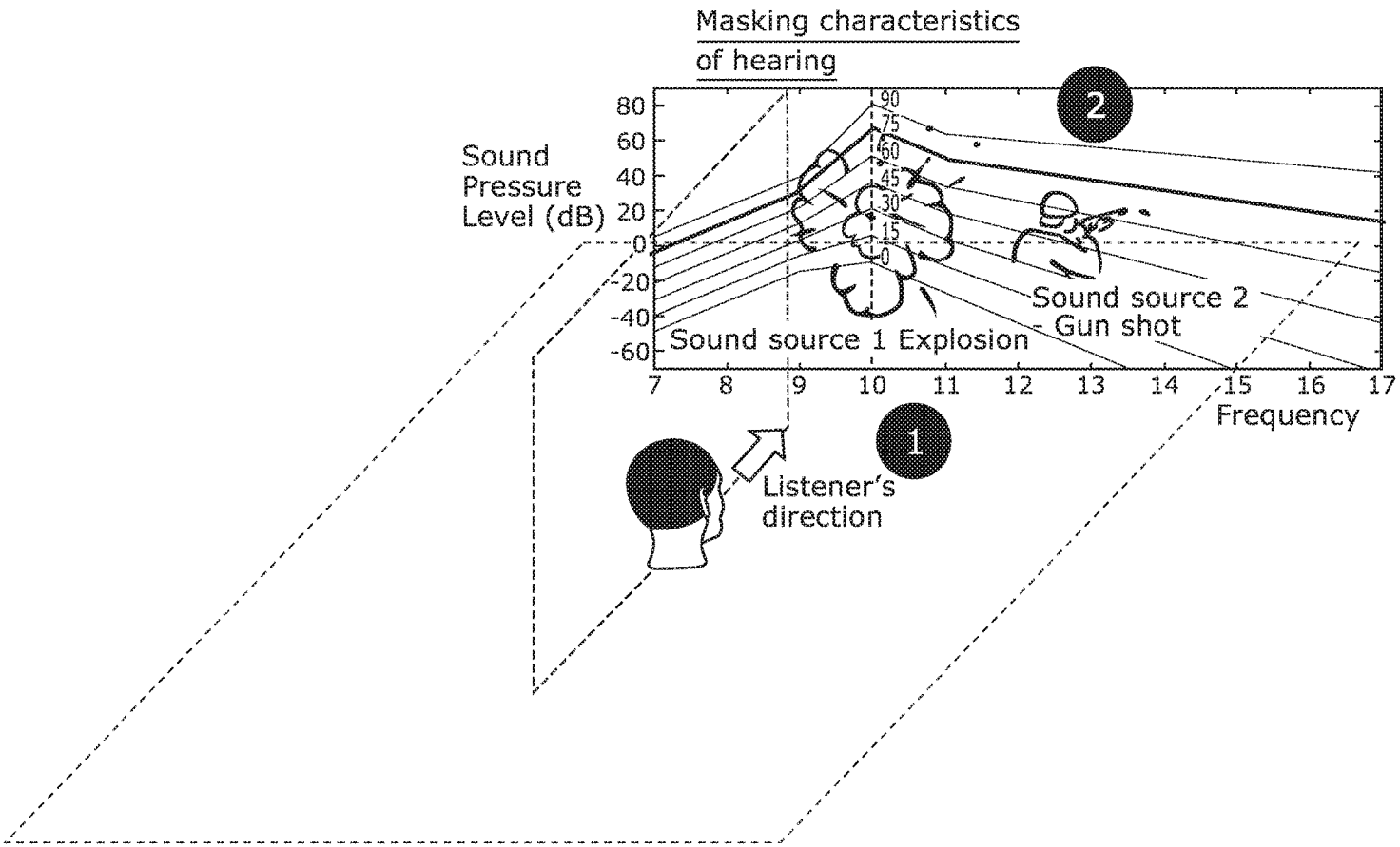
FIG. 10 is a diagram showing an exemplary method for determining the perceptual importance of audio objects.

As shown in FIG. 10, the audio scene analysis unit 100 determines that an audio object containing many frequency components that are masked has a lower perceptual importance than that of an audio object containing many frequency components that are not masked.

For example, in FIG. 10, Sound source 1 indicated by Black circle 1 is an explosion sound, and Sound source 2 indicated by Black circle 2 is a gunshot sound, which contains a larger number of frequencies that are masked in human hearing than an explosion sound. In this case, it is determined that Sound source 1 has a higher perceptual importance than that of Sound source 2.

The audio scene analysis unit 100 determines the perceptual importance of audio objects as described above, and, according to the sum of the perceptual importance, assigns a number of bits to each of the audio objects during encoding by the object-based encoder and the channel-based encoder.

The method is, for example, as follows.

When A is the number of channels of the channel-based input signal, B is the number of objects of the object-based input signal, "a" is the weight to the channel-based input signal, "b" is the weight to the object-based input signal, and T is a total number of bits available for encoding (where T represents a total number of bits given to the channel-based and object-based audio signals, from which the number of bits given to the audio scene information and the number of bits given to header information have already been subtracted), a number of bits calculated by T*(b*B/(a*A+b*B)) is first temporarily allocated to the object-based signal. That is, a number of bits calculated by T*(b/(a*A+b*B)) is allocated to each of the individual audio objects. Here, "a" and "b" are each a positive value in the neighborhood of 1.0, but a specific value may be set according to the properties of content and the listener's preference.

Next, for each individual audio object, the perceptual importance is determined by the methods shown in FIGS. 2 to 10, and the number of bits allocated to each individual audio object is multiplied by a value greater than 1 if the perceptual importance is high, or multiplied by a value less than 1 if the perceptual importance is low. Such a process is executed on all audio objects, and the total is calculated. When the total is X, Y is determined by Y=T−X, and the obtained Y is allocated for encoding of the channel-based audio signal. The numbers of bits for the individual values calculated as above are allocated to the individual audio objects.

Figure 11:
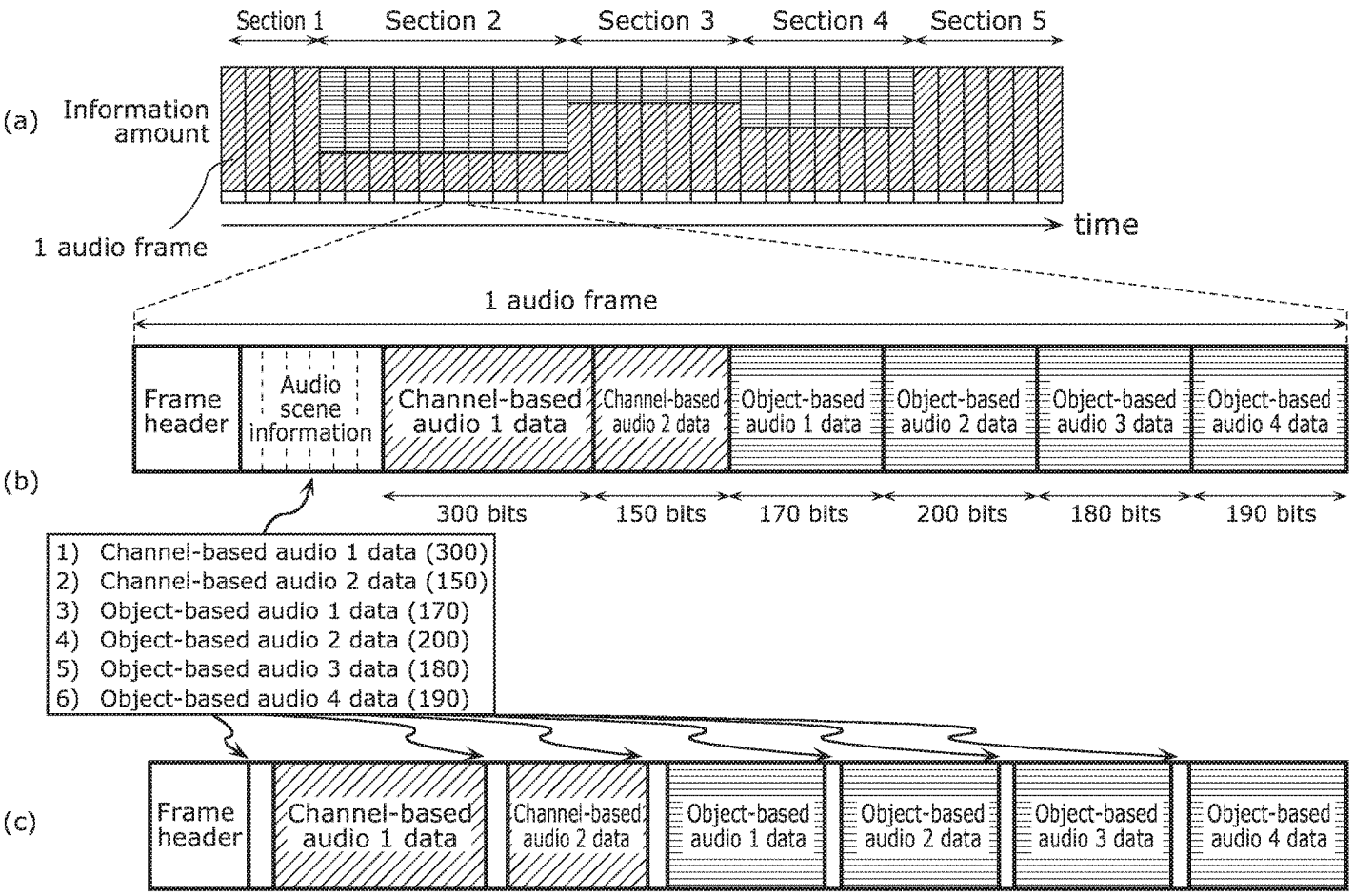
FIG. 11 shows a configuration of a bit stream.

(a) of FIG. 11 shows an example of the allocation, for each audio frame, of the number of bits thus allocated. In (a) of FIG. 11, the diagonally striped portion shows the sum of the encoding amounts of the channel-based audio signal. The horizontally striped portion shows the sum of the encoding amounts of the object-based audio signal. The white portion shows the sum of the encoding amounts of the audio scene information.

In (a) of FIG. 11, Section 1 is a section in which no audio object is present. Therefore, all bits are allocated to the channel-based audio signal. Section 2 shows a state when audio objects have appeared. Section 3 shows a case where the sum of the perceptual importance of the audio objects is less than that in Section 2. Section 4 shows a case where the sum of the perceptual importance of the audio objects is greater than that in Section 3. Section 5 shows a state in which no audio object is present.

(b) and (c) of FIG. 11 show an example of the details of the numbers of bits respectively allocated to individual audio objects and how the items of information (audio scene information) thereof are arranged in a bit stream in a given audio frame.

The numbers of bits allocated to individual audio objects are determined by the perceptual importance of each of the audio objects. The perceptual importance (audio scene information) of each of the audio objects may be all placed together in a predetermined location on the bit stream as shown in (b) of FIG. 11, or may be placed in association with each individual audio object as shown in (c) of FIG. 11.

Next, the channel-based encoder 101 encodes the channel-based audio signal output from the audio scene analysis unit 100 by using the number of bits allocated by the audio scene analysis unit 100.

Next, the object-based encoder 102 encodes the object-based audio signal output from the audio scene analysis unit 100 by using the number of bits allocated by the audio scene analysis unit 100.

Next, the audio scene encoding unit 103 encodes the audio scene information (in the above-described example, the perceptual importance of the object-based audio signal). For example, the audio scene encoding unit 103 encodes the perceptual importance as the information amount of the object-based audio signal in the relevant audio frame.

Finally, the multiplexing unit 104 multiplexes the channel-based encoded signal that is an output signal of the channel-based encoder 101, the object-based encoded signal that is an output signal of the object-based encoder 102, and the audio scene encoded signal that is an output signal of the audio scene encoding unit 103 to generate a bit stream. That is, a bit stream as shown in (b) of FIG. 11 or (c) of FIG. 11 is generated.

Here, the object-based encoded signal and the audio scene encoded signal (in this example, the information amount of the object-based audio signal in the relevant audio frame) are multiplexed in the following manner.

(1) The object-based encoded signal and the information amount thereof are encoded as a pair.

(2) The encoded signal of each audio object and the information amount corresponding thereto are encoded as a pair.

Here, "as a pair" does not necessarily mean that the pieces of information are arranged adjacent to each other. The term "as a pair" means that each of the encoded signals and the information amount corresponding thereto are multiplexed in association with each other. Doing so allows the process corresponding to the audio scene to be controlled for each audio object at the decoder side. In that sense, the audio scene encoded signal is preferably stored before the object-based encoded signal.

As described above, according to the present embodiment, there is provided an audio encoding device that encodes an input signal, the input signal including a channel-based audio signal and an object-based audio signal, the audio encoding device including: an audio scene analysis unit configured to determine an audio scene from the input signal and detect audio scene information; a channel-based encoder that encodes the channel-based audio signal output from the audio scene analysis unit; an object-based encoder that encodes the object-based audio signal output from the audio scene analysis unit; and an audio scene encoding unit configured to encode the audio scene information.

This makes it possible to appropriately reconfigure the channel-based audio signal and the object-based audio signal, thus achieving high audio quality and a reduced computational load at the decoder side. This is because a signal (acoustic signal containing background sound or reverberation) input on a channel basis can be directly encoded.

Furthermore, with the audio encoding device according to the present embodiment, it is also possible to reduce the bit rate. This is because the number of audio objects can be reduced by mixing an audio object that can be represented on a channel basis with a channel-based signal.

Furthermore, with the audio encoding device according to the present embodiment, it is possible to increase the degree of freedom in rendering at the decoder side. This is because it is possible to detect a sound that can be converted to an audio object from among channel-based signals, convert the sound to an audio object, and record and transmit the audio object.

Furthermore, with the audio encoding device according to the present embodiment, it is possible to appropriately allocate a number of encoding bits to each of the channel-based audio signal and the object-based audio signal during encoding of these signals.

[Embodiment 2]

Hereinafter, an audio decoding device according to Embodiment 2 will be described with reference to the drawings.

Figure 12:
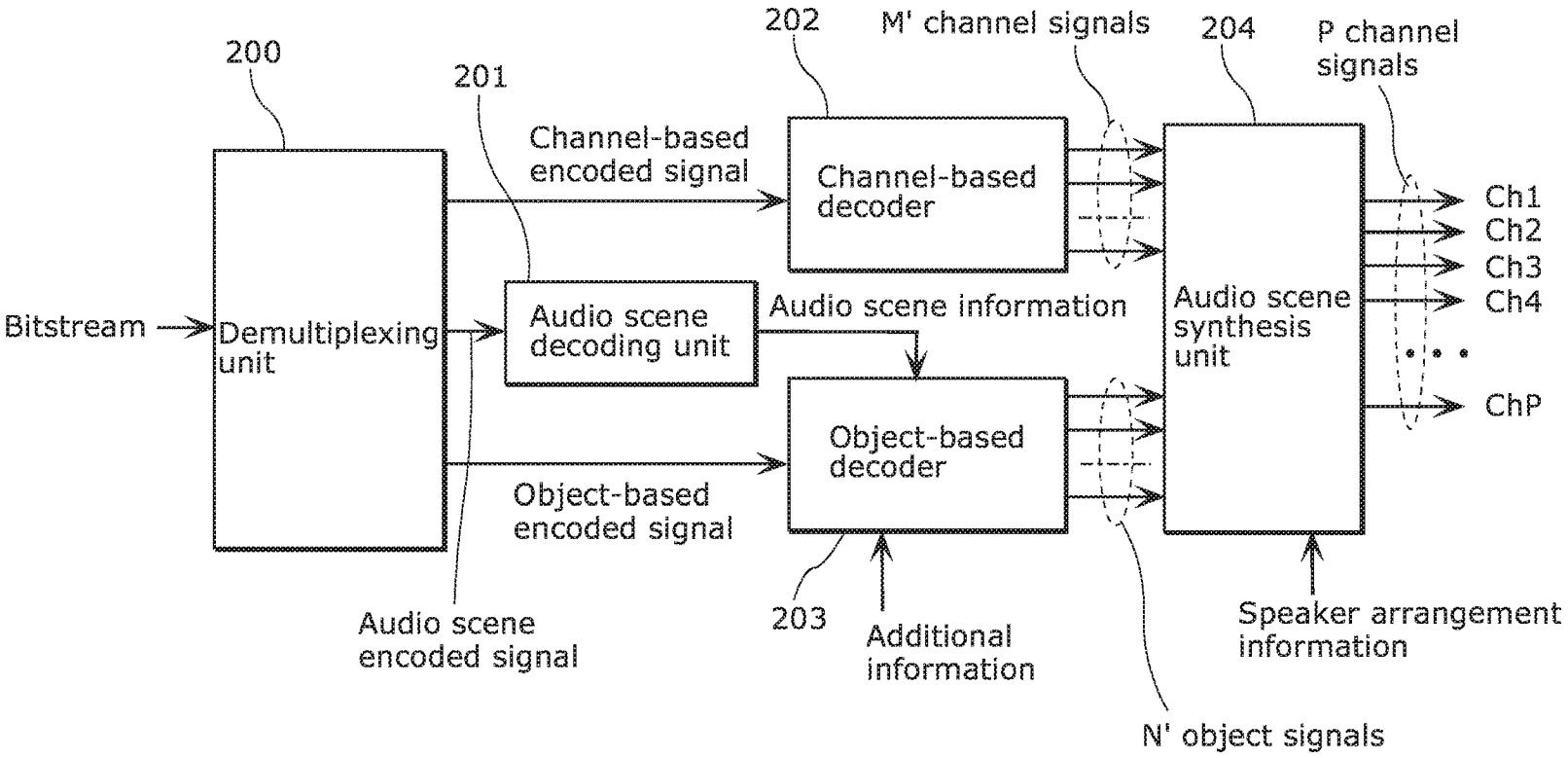
FIG. 12 is a diagram showing a configuration of an audio decoding device according to Embodiment 2.

FIG. 12 is a diagram showing a configuration of the audio decoding device according to the present embodiment.

As shown in FIG. 12, the audio decoding device includes a demultiplexing unit 200, an audio scene decoding unit 201, a channel-based decoder 202, an object-based decoder 203, and an audio scene synthesis unit 204.

The demultiplexing unit 200 demultiplexes a bit stream input to the demultiplexing unit 200 into a channel-based encoded signal, an object-based encoded signal and an audio scene encoded signal.

The audio scene decoding unit 201 decodes the audio scene encoded signal demultiplexed in the demultiplexing unit 200, and outputs audio scene information.

The channel-based decoder 202 decodes the channel-based encoded signal demultiplexed in the demultiplexing unit 200, and outputs the channel signals.

The object-based decoder 203 decodes the object-based encoded signal based on the audio scene information, and outputs the object signals.

The audio scene synthesis unit 204 synthesizes an audio scene based on the channel signals that are output signals of the channel-based decoder 202, the object signals that are output signals of the object-based decoder 203, and speaker arrangement information that is provided separately.

The operation of the audio decoding device configured as above will be described below.

First, in the demultiplexing unit 200, the input bit stream is demultiplexed into the channel-based encoded signal, the object-based encoded signal, and the audio scene encoded signal are.

In the present embodiment, the audio scene encoded signal is a signal resulting from encoding the information of the perceptual importance of audio objects. The perceptual importance may be encoded as the information amount of each audio object, or may be encoded as the ranking of importance, such as first, second, and third ranks. Alternatively, the perceptual importance may be encoded as both the information amount and the ranking of importance.

The audio scene encoded signal is decoded in the audio scene decoding unit 201, and the audio scene information is output.

Next, the channel-based decoder 202 decodes the channel-based encoded signal, and the object-based decoder 203 decodes the object-based encoded signal based on the audio scene information. At this time, additional information indicating the reproduction status is given to the object-based decoder 203. For example, the additional information indicating the reproduction status may be information of the computing capacity of a processor executing the process.

Note that if the computing capacity is insufficient, an audio object with a low perceptual importance is skipped. When the perceptual importance is represented as an encoding amount, the aforementioned skipping process may be executed based on the information of that encoding amount. When the perceptual importance is represented as ranking, such as first, second, and third ranks, an audio object with a low rank may be read and discarded directly (without being processed).

Figure 13:
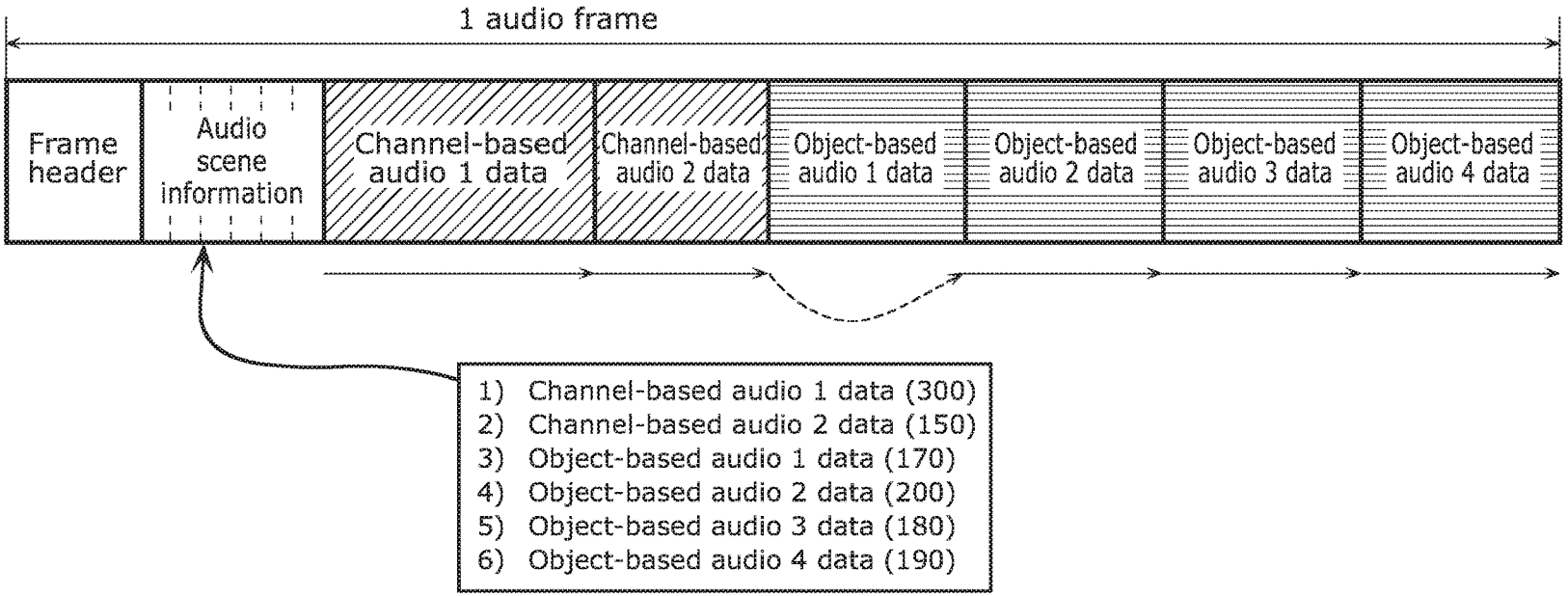
FIG. 13 shows a configuration of a bit stream and how skipping reproduction is performed.

FIG. 13 shows a case where, when an audio object has a low perceptual importance and the perceptual importance is represented as an encoding amount, the audio object is skipped from the audio scene information based on the information of the encoding amount.

The additional information given to the object-based decoder 203 may be attribute information of the listener. For example, when the listener is a child, only audio objects suitable for children may be selected, and the rest may be discarded.

Here, when skipping is performed, an audio object is skipped based on the encoding amount corresponding to that audio object. In this case, metadata is given to each audio object, and the metadata defines a character that the audio object indicates.

Finally, in the audio scene synthesis unit 204, the signals assigned to speakers are determined based on the channel signals that are output signals of the channel-based decoder 202, the object signals that are output signals of the object-based decoder 203, and the speaker arrangement information that is provided separately, and the signals are reproduced.

The method is as follows.

The output signals of the channel-based decoder 202 are directly assigned to the respective channels. The output signals of the object-based decoder 203 are assigned so as to distribute (render) the sound to the channels according to the reproduction position information of the objects originally contained in the object-based audio signal such that the sound image is configured at the position corresponding to the reproduction position information. This may be performed by any known method.

Figure 14:
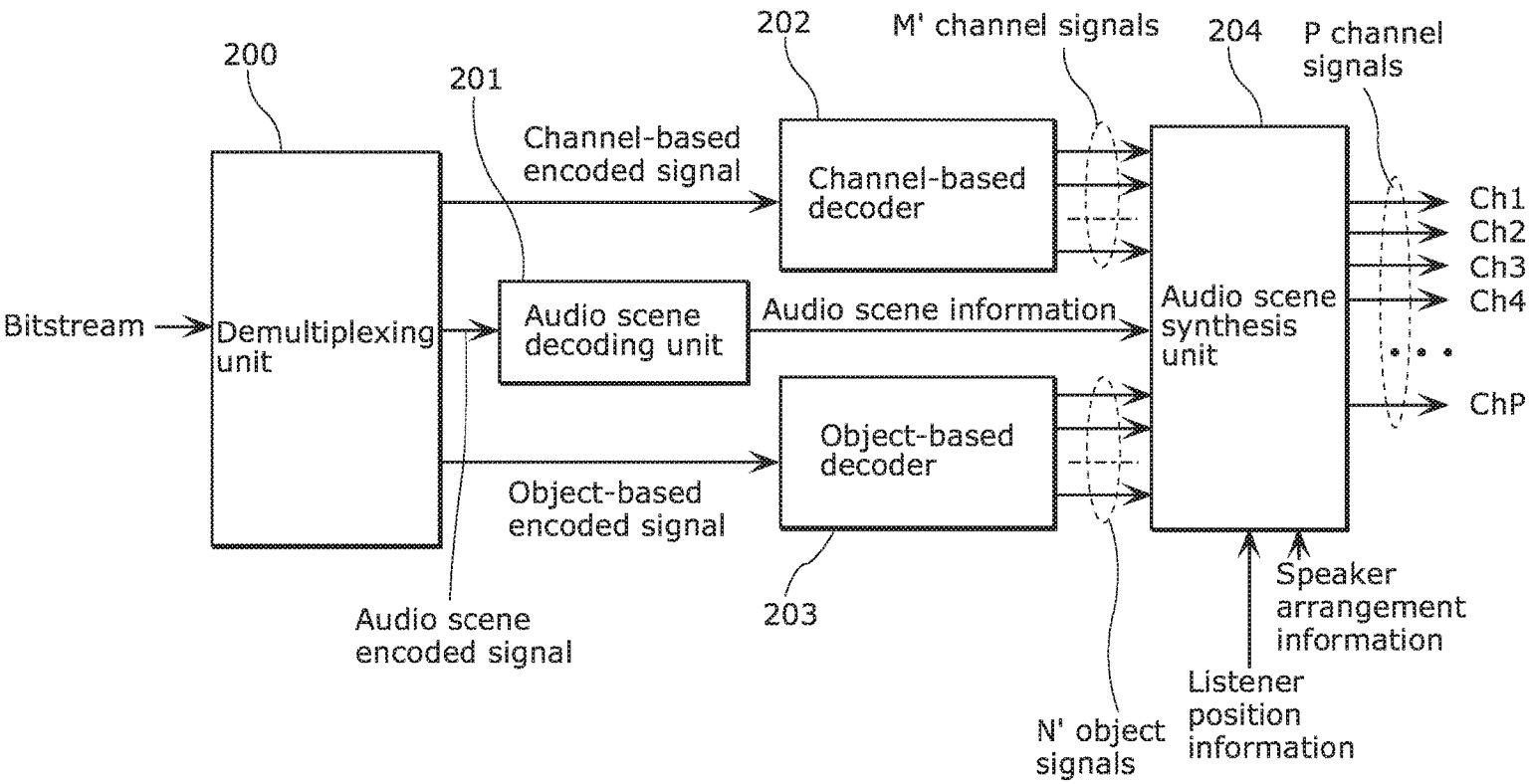
FIG. 14 is a diagram showing a configuration of the audio decoding device according to Embodiment 2.

Note that FIG. 14 is a schematic diagram showing the same configuration of the audio decoding device as that of FIG. 12 except that the listener position information is input to the audio scene synthesis unit 204. An HRTF may be configured according to the position information and the object reproduction position information of the objects originally included in the object-based decoder 203.

As described above, an audio decoding device according to the present embodiment is an audio decoding device that decodes an encoded signal resulting from encoding an input signal, the input signal including a channel-based audio signal and an object-based audio signal, the encoded signal containing a channel-based encoded signal resulting from encoding the channel-based audio signal, an object-based encoded signal resulting from encoding the object-based audio signal, and an audio scene encoded signal resulting from encoding audio scene information extracted from the input signal, the audio decoding device including: a demultiplexing unit configured to demultiplex the encoded signal into the channel-based encoded signal, the object-based encoded signal, and the audio scene encoded signal; an audio scene decoding unit configured to extract, from the encoded signal, an encoded signal of the audio scene information, and decode the encoded signal of the audio scene information; a channel-based decoder that decodes the channel-based audio signal; an object-based decoder that decodes the object-based audio signal by using the audio scene information decoded by the audio scene decoding unit; and an audio scene synthesis unit configured to combine an output signal of the channel-based decoder and an output signal of the object-based decoder based on speaker arrangement information provided separately from the audio scene information, and reproduce a combined audio scene synthesis signal.

With this configuration, the perceptual importance of the audio object is used as the audio scene information, and thereby, it is possible to perform reproduction, while minimizing degradation of the audio quality, by skipping an audio object according to the perceptual importance, even in the case of executing the process with a processor having a low computing capacity.

Furthermore, with the audio decoding device according to the present embodiment, the perceptual importance of the audio object is represented as an encoding amount and used as the audio scene information, and thereby, the amount to be skipped can be known in advance at the time of skipping, thus making it possible to execute the skipping process in a very simple manner.

Further, with the audio decoding device according to the present embodiment, the provision of the listener position information to the audio scene synthesis unit 204 makes it possible to execute the process while generating an HRTF from this position information and the position information of the audio object. Thereby, it is possible to achieve audio scene synthesis with a heightened perception of reality.

Although the audio encoding device and the audio decoding device according to an aspect of the present disclosure have been described above based on embodiments, the disclosure is not limited to these embodiments. Various modifications to the present embodiments that can be conceived by those skilled in the art are within the scope of the disclosure without departing from the gist of the disclosure.

INDUSTRIAL APPLICABILITY

An audio encoding device and an audio decoding device according to the present disclosure can appropriately encode background sound and audio objects and can also reduce the amount of computation at the decoding side, and therefore are widely applicable to audio reproduction equipment and AV reproduction equipment, which involves images.

The invention claimed is:

1. An audio decoding device that decodes an encoded signal including a channel-based encoded signal, an object-based encoded signal, and an audio scene encoded signal, the audio decoding device comprising:

a demultiplexing unit configured to demultiplex the encoded signal into the channel-based encoded signal, the object-based encoded signal, and the audio scene encoded signal;

an audio scene decoding unit configured to decode the audio scene encoded signal and output audio scene information;

a channel-based decoder that decodes the channel-based encoded signal;

an object-based decoder that decodes the object-based encoded signal by using the audio scene information; and an audio scene synthesis unit configured to combine an output signal of the channel-based decoder and an output signal of the object-based decoder based on speaker arrangement information provided separately from the audio scene information, and reproduce a combined audio scene synthesis signal, wherein the audio scene information is importance information of audio objects, and the audio decoding device skips an audio object included in the audio objects that has a low importance when a computational resource necessary for decoding is insufficient.

* * * * *